US007208116B2

(12) United States Patent
Manning et al.

(10) Patent No.: US 7,208,116 B2
(45) Date of Patent: Apr. 24, 2007

(54) NICKEL BASE SUPERALLOY

(75) Inventors: Andrew J Manning, Derby (GB); David Knowles, Dorchester (GB); Colin J Small, Derby (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 09/962,125

(22) Filed: Sep. 26, 2001

(65) Prior Publication Data

US 2002/0041821 A1 Apr. 11, 2002

(30) Foreign Application Priority Data

Sep. 29, 2000 (GB) ..... 0024031.7

(51) Int. Cl.
*C22C 19/05* (2006.01)

(52) U.S. Cl. ..... 420/449; 148/428; 420/450

(58) Field of Classification Search ..... 420/446, 420/447, 448, 449; 148/428
See application file for complete search history.

(56) References Cited

U.S. PATENT DOCUMENTS

| | | | | |
|---|---|---|---|---|
| 2,766,155 | A | 10/1956 | Betteridge | |
| 3,145,124 | A | 8/1964 | Hignett | |
| 3,748,192 | A | 7/1973 | Boesch | |
| 4,030,946 | A | 6/1977 | Muzyka | |
| 4,207,098 | A * | 6/1980 | Shaw | 420/443 |
| 5,120,373 | A | 6/1992 | Miller | |
| 5,328,659 | A * | 7/1994 | Tillman et al. | 148/410 |
| 5,649,280 | A | 7/1997 | Blankenship | |

FOREIGN PATENT DOCUMENTS

| | | | |
|---|---|---|---|
| EP | 248757 | A | 12/1987 |
| EP | 803585 | A | 10/1997 |
| EP | 00803585 | A1 * | 10/1997 |
| GB | 1156721 | P | 7/1969 |
| GB | 1166686 | P | 10/1969 |
| GB | 1318267 | P | 5/1973 |
| GB | 1449273 | P | 9/1976 |
| WO | WO 18660 | A | 10/1992 |
| WO | WO 13849 | A | 6/1994 |

* cited by examiner

*Primary Examiner*—John P. Sheehan
(74) *Attorney, Agent, or Firm*—Jeffrey S. Melcher; Manelli Denison & Selter, PLLC

(57) ABSTRACT

A nickel base superalloy comprising 14.0 to 20.0 wt % cobalt, 13.5 to 17.0 wt % chromium, 2.5 to 4.0 wt % aluminium, 3.4 to 5.0 wt % titanium, 0 to 3.0 wt % tantalum, 3.8 to 5.5 wt % molybdenum, 0.035 to 0.07 wt % carbon, 0.01 to 0.04 wt % boron, 0.055 to 0.075 wt % zirconium, 0 to 0.4 wt % hafnium and the balance nickel plus incidental impurities. The nickel base superalloy is suitable for use as gas turbine engine high pressure compressor rotor discs or turbine discs. It is capable of operation at temperatures above 700° C. and has good fatigue crack propagation resistance, creep resistance and tensile strength.

31 Claims, 6 Drawing Sheets

NICKEL BASE SUPERALLOY

FIELD OF THE INVENTION

The present invention relates to a nickel base superalloy, particularly to a nickel base superalloy for turbine rotor discs or high pressure compressor rotor discs for gas turbine engines.

BACKGROUND OF THE INVENTION

There is a requirement for future gas turbine engines to have increased performance, thermodynamic efficiency and component cyclic life, maintained component integrity and reduced weight and cost. This requires increased pressure ratio in the compressor, increased turbine entry temperature and increased turbine speed. The increase in pressure ratio in the compressor requires the compressor rotor disc to operate at higher temperatures. The increase in turbine entry temperature requires the turbine rotor disc to operate at higher temperature. The increase in turbine speed requires the turbine rotor disc to operate at higher stresses. The above requirements result in the need for high pressure compressor rotor discs and turbine rotor discs capable of operating at increased temperature and having increased strength.

Nickel base superalloys of high strength, around 1500 Mpa, and increased temperature capability, above 700° C., must maintain damage tolerance. As a result of normal operation, rotor discs are subject to cyclic mechanical stresses and contain features, such as bolt holes, which represent a stress concentration and are potential sites for fatigue damage. The rotor discs are also exposed to thermal gradients leading to exposure to thermal stress patterns. The greatest temperature is at the rim of the rotor disc. The rotor discs therefore must maintain a high level of creep resistance to prevent distortion in addition to resistance to fatigue.

The operating requirements placed on the rotor disc depend on two factors. Firstly, whether the rotor disc is a turbine rotor disc or a high pressure compressor rotor disc. Secondly, whether the gas turbine engine is an aero gas turbine engine, a marine gas turbine engine or an industrial gas turbine engine. The rotor discs of an industrial gas turbine engine require a relatively low cycle life compared to the rotor discs of an aero gas turbine engine. The rotor discs of an industrial gas turbine engine are more susceptible to creep damage and microstructural degradation compared to the rotor discs of an aero gas turbine engine. This difference arises because an industrial gas turbine engine operates for 100's of 1000's of hours compared to 10's of 1000's of hours for an aero gas turbine engine.

Gas turbine engine rotor discs are currently manufactured from nickel base superalloys such as Waspaloy, Udimet 720Li and RR1000. Waspaloy has high fatigue crack propagation resistance, phase stability, processing ability and is of relatively low cost. However Waspaloy has relatively low strength. The relative strength of Waspaloy is directly related to the gamma prime fraction of Waspaloy, which contains 24% volume fraction gamma prime phase. Udimet 720Li has fatigue crack propagation resistance less than Waspaloy, but has higher strength than Waspaloy. The high, 45 wt %, gamma prime phase fraction in Udimet 720Li is responsible for the higher strength. RR1000 has fatigue crack propagation resistance similar to Waspaloy, but has creep and tensile strength higher than Waspaloy. The high, 48 wt %, gamma prime phase fraction in RR1000 is responsible for the higher strength. RR1000 has similar strength to Udimet 720Li, but has greater fatigue crack propagation resistance and creep rupture life. However, RR1000 is relatively expensive compared to Waspaloy and Udimet 720Li due to its highly alloyed composition. Waspaloy and Udimet 720Li can be manufactured by powder metallurgy processing or by cast and wrought processing. RR1000 is currently manufactured by powder metallurgy processing which minimises segregation and has improved ultrasonic inspectability compared to the cast and wrought route.

SUMMARY OF THE INVENTION

Accordingly the present invention seeks to provide a novel nickel base superalloy which overcomes, or reduces, the above mentioned problems. The present invention also seeks to provide a novel nickel base superalloy for a rotor disc which is capable of operating at higher temperatures whilst maintaining alloy stability.

Accordingly the present invention provides a nickel base superalloy consisting of 14.0 to 20.0 wt % cobalt, 13.5 to 17.0 wt % chromium, 2.5 to 4.0 wt % aluminium, 3.4 to 5.0 wt % titanium, 0 to 3.0 wt % tantalum, 3.8 to 5.5 wt % molybdenum, 0.035 to 0.07 wt % carbon, 0.01 to 0.04 wt % boron, 0.055 to 0.075 wt % zirconium, 0 to 0.4 wt % hafnium and the balance nickel plus incidental impurities.

The nickel base superalloy may consist of 15.0 to 19.0 wt % cobalt, 14.5 to 16.0 wt % chromium, 2.7 to 3.5 wt % aluminium, 3.6 to 4.7 wt % titanium, 0 to 2.8 wt % tantalum, 4.0 to 5.0 wt % molybdenum, 0.035 to 0.07 wt % carbon, 0.01 to 0.04 wt % boron, 0.055 to 0.075 wt % zirconium, 0 to 0.4 wt % hafnium and the balance nickel plus incidental impurities.

Preferably the nickel base superalloy consists of 16.0 to 20.0 wt % cobalt, 14.5 to 17.0 wt % chromium, 2.5 to 3.5 wt % aluminium, 3.7 to 5.0 wt % titanium, 0 to 3.0 wt % tantalum, 3.8 to 4.5 wt % molybdenum, 0.035 to 0.070 wt % carbon, 0.01 to 0.04 wt % boron, 0.055 to 0.075 wt % zirconium, 0 to 0.4 wt % hafnium and the balance nickel plus incidental impurities.

Preferably the nickel base superalloy consists of 16.5 to 19.0 wt % cobalt, 15.0 to 16.0 wt % chromium, 2.7 to 3.5 wt % aluminium, 3.75 to 4.7 wt % titanium, 1.0 to 3.0 wt % tantalum, 3.8 to 4.5 wt % molybdenum, 0.035 to 0.070 wt % carbon, 0.01 to 0.04 wt % boron, 0.055 to 0.075 wt % zirconium, 0 to 0.04 wt % hafnium and the balance nickel plus incidental impurities.

Preferably the nickel base superalloy consists of 18.0 wt % cobalt, 15.5 wt % chromium, 2.8 wt % aluminium, 3.8 wt % titanium, 1.75 wt % tantalum, 4.25 wt % molybdenum, 0.045 wt % carbon, 0.02 wt % boron, 0.06 wt % zirconium, 0.35 wt % hafnium and the balance nickel plus incidental impurities.

Preferably the superalloy comprises gamma prime phase in a gamma phase matrix, the ratio of aluminium to (titanium and tantalum) is at an optimum for providing the maximum strength per unit fraction of gamma prime phase.

Preferably the ratio of aluminium to (titanium and tantalum) is 0.6 to 0.75 in at %.

Preferably the superalloy comprises (Ti+Ta+Hf)C carbide and M23C6 carbide particles on the grain boundaries, the carbide particles have dimensions of 350 to 550 nm.

Preferably the gamma phase matrix has a grain size of 14 to 20 μm and the gamma prime phase has a size of less than 300 nm.

Preferably the superalloy comprises 0.5 to 1.5 wt % (Ti+Ta+Hf)C carbide, the (Ti+Ta+Hf)C carbide comprising up to 60 wt % Hf.

Preferably the nickel base superalloy comprises 44 wt % gamma prime phase.

Alternatively the nickel base superalloy may consist of 18.0 wt % cobalt, 15.5 wt % chromium, 2.8 wt % aluminium, 3.8 wt % titanium, 4.25 wt % molybdenum, 0.045 wt % carbon, 0.02 wt % boron, 0.06 wt % zirconium and the balance nickel plus incidental impurities.

The superalloy may comprise TiC carbide and M23C6 carbide particles on the grain boundaries, the carbide particles have dimensions of 350 to 550 nm.

The superalloy may comprise 0.5 to 1.5 wt % TiC carbide, the TiC carbide comprising 40 to 60 wt % Ti.

Alternatively the nickel base superalloy may consist of 18.0 wt % cobalt, 15.5 wt % chromium, 2.8 wt % aluminium, 4.4 wt % titanium, 1.75 wt % tantalum, 4.5 wt % molybdenum, 0.045 wt % carbon, 0.02 wt % boron, 0.06 wt % zirconium and the balance nickel plus incidental impurities.

Alternatively the nickel base superalloy may consist of 17.0 wt % cobalt, 15.0 wt % chromium, 3.1 wt % aluminium, 4.4 wt % titanium, 2.5 wt % tantalum, 4.0 wt % molybdenum, 0.045 wt % carbon, 0.02 wt % boron, 0.06 wt % zirconium and the balance nickel plus incidental impurities.

Alternatively the nickel base superalloy may consist of 17.0 wt % cobalt, 15.0 wt % chromium, 3.1 wt % aluminium, 4,4 wt % titanium, 2.5 wt % tantalum, 4.0 wt % molybdenum, 0.045 wt % carbon, 0.035 wt % boron, 0.06 wt % zirconium and the balance nickel plus incidental impurities.

Alternatively the nickel base superalloy may consist of 17.0 wt % cobalt, 15.0 wt % chromium, 3.1 wt % aluminium, 4.4 wt % titanium, 2.0 wt % tantalum, 4.5 wt % molybdenum, 0.045 wt % carbon, 0.035 wt % boron, 0.06 wt % zirconium, 0.35 wt % hafnium and the balance nickel plus incidental impurities.

The nickel base superalloy may comprise 55 wt % gamma prime phase.

Preferably the nickel base superalloy comprises 40 to 60 wt % gamma prime phase.

The nickel base superalloy may be used to manufacture gas turbine engine rotor discs. The rotor disc may be a turbine rotor disc or a high pressure compressor rotor disc.

The present invention also provides an apparatus for developing a nickel base superalloy comprising means for determining the tensile strength and proof strength of a nickel base superalloy composition, means for determining the phase compositions and phase fractions of the nickel base superalloy composition and means for optimising the nickel base superalloy composition such that the nickel base superalloy composition has maximum tensile strength, maximum proof strength and minimum formation of detrimental sigma phases and eta phases which reduce creep rupture strength and fatigue crack propagation resistance.

Preferably the means for determining the tensile strength and proof strength of a nickel base superalloy composition comprises a computer having a neural network.

Preferably the neural network determines the ultimate tensile strength and the 0.2% proof strength.

Preferably the neural network comprises a Bayesian multi-layer perception neural network.

Preferably the means for determining the phase compositions and phase fractions of the nickel base superalloy composition comprises a computer having a thermodynamic model.

Preferably the means for determining the phase compositions and phase fractions of the nickel base superalloy composition comprises a computer having a database containing thermodynamic data of the nickel base superalloy.

Preferably the database comprises enthalpies of formation, entropy, chemical potentials, interaction coefficients, heat capacity and crystal structures.

The present invention also provides a method for developing a nickel base superalloy comprising determining the tensile strength and proof strength of a nickel base superalloy composition, determining the phase compositions and phase fractions of the nickel base superalloy composition and optimising the nickel base superalloy composition such that the nickel base superalloy composition has maximum tensile strength, maximum proof strength and minimum formation of detrimental sigma phases and eta phases which reduce creep rupture strength and fatigue crack propagation resistance.

Preferably a neural network determines the tensile strength and proof strength of a nickel base superalloy composition Preferably the neural network determines the ultimate tensile strength and the 0.2% proof strength.

Preferably the neural network comprises a Bayesian multi-layer perception neural network.

Preferably a thermodynamic model determines the phase compositions and phase fractions of the nickel base superalloy.

Preferably a database containing thermodynamic data of the nickel base superalloy is used for determining the phase compositions and phase fractions of the nickel base superalloy composition.

Preferably the database comprises enthalpies of formation, entropy, chemical potentials, interaction coefficients, heat capacity and crystal structures.

BRIEF DESCRIPTION OF THE DRAWINGS

The present invention will be more fully described by way of example with reference to the accompanying drawings in which.

DETAILED DESCRIPTION OF THE INVENTION

Figure 1:
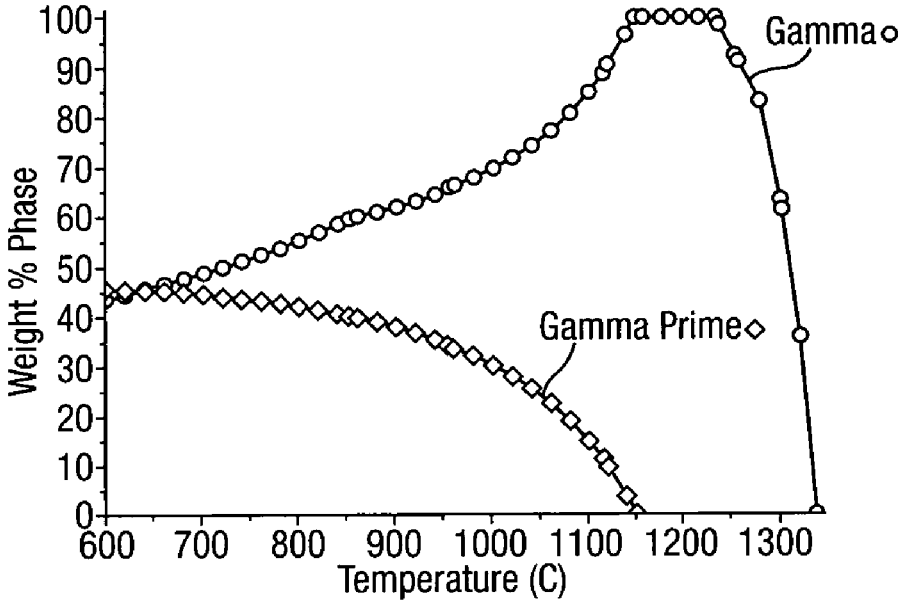
FIG. 1 is a graph showing the change in equilibrium fraction of the gamma phase and gamma prime phase in Alloy 1 of the present invention with temperature.

A nickel base superalloy according to the present invention consists of 14.0 to 20.0 wt % cobalt, 13.5 to 17.0 wt % chromium, 2.5 to 4.0 wt % aluminium, 3.4 to 5.0 wt % titanium, 0 to 3.0 wt % tantalum, 3.8 to 5.5 wt % molybdenum, 0.035 to 0.07 wt % carbon, 0.01 to 0.04 wt % boron, 0.055 to 0.075 wt % zirconium, 0 to 0.4 wt % hafnium and the balance nickel plus incidental impurities.

Preferably the alloy consists of 15.0 to 19.0 wt % cobalt, 14.5 to 16.0 wt % chromium, 2.7 to 3.5 wt % aluminium, 3.6 to 4.7 wt % titanium, 0 to 2.8 wt % tantalum, 4.0 to 5.0 wt % molybdenum, 0.035 to 0.07 wt % carbon, 0.01 to 0.04 wt % boron, 0.055 to 0.075 wt % zirconium, 0 to 0.4 wt % hafnium and the balance nickel plus incidental impurities.

Four alloys according to the present invention have been produced.

Alloy 1 consists of 18.0 wt % cobalt, 15.5 wt % chromium, 2.8 wt % aluminium, 3.8 wt % titanium, 1.75 wt % tantalum, 4.25 wt % molybdenum, 0.045 wt % carbon, 0.02 wt % boron, 0.06 wt % zirconium, 0.35 wt % hafnium and the balance nickel plus incidental impurities. Alloy 1 comprises gamma prime phase in a gamma phase matrix, the ratio of aluminium to (titanium and tantalum) is at an optimum for providing the maximum strength per unit fraction of gamma prime phase. The ratio of aluminium to (titanium and tantalum) is 0.6 to 0.75 in at %. Alloy 1 comprises 44 wt % gamma prime phase.

Alloy 1 comprises (Ti+Ta+Hf)C carbide and M23C6 carbide particles on the grain boundaries, the carbide particles have dimensions of 350 to 550 nm.

The gamma phase matrix has a grain size of 14 to 20 μm and the gamma prime phase has a size of less than 300 nm.

Alloy 1 comprises 0.5 to 1.5 wt % (Ti+Ta+Hf)C carbide and the (Ti+Ta+Hf)C carbide comprises up to 60 wt % Hf.

Alloy 2 consists of 18.0 wt % cobalt, 15.5 wt % chromium, 2.8 wt % aluminium, 3.8 wt % titanium, 4.25 wt % molybdenum, 0.045 wt % carbon, 0.02 wt % boron, 0.06 wt % zirconium and the balance nickel plus incidental impurities.

Alloy 2 comprises TiC carbide and M23C6 carbide particles on the grain boundaries, the carbide particles have dimensions of 350 to 550 nm. Alloy 2 comprises 0.5 to 1.5 wt % TiC carbide, the TiC carbide comprises 40 to 60 wt % Ti.

Alloy 3 consists of 18.0 wt % cobalt, 15.5 wt % chromium, 2.8 wt % aluminium, 4.4 wt % titanium, 1.75 wt % tantalum, 4.5 wt % molybdenum, 0.045 wt % carbon, 0.02 wt % boron, 0.06 wt % zirconium and the balance nickel plus incidental impurities.

Alloy 4 consists of 17.0 wt % cobalt, 15.0 wt % chromium, 3.1 wt % aluminium, 4.4 wt % titanium, 2.5 wt % tantalum, 4.0 wt % molybdenum, 0.045 wt % carbon, 0.02 wt % boron, 0.06 wt % zirconium and the balance nickel plus incidental impurities. Alloy 4 comprises 55 wt % gamma prime phase.

Waspaloy consists of 13.5 wt % cobalt, 19.5 wt % chromium, 1.4 wt % aluminium, 3.05 wt % titanium, 4.25 wt % molybdenum, 0.06 wt % carbon, 0.0065 wt % boron, 0.05 wt % zirconium and the balance nickel plus incidental impurities.

Udimet 720Li consists of 15 wt % cobalt, 16 wt % chromium, 2.5 wt % aluminium, 5 wt % titanium, 3 wt % molybdenum, 0.015 wt % carbon, 0.015 wt % boron, 0.035 wt % zirconium, 1.25 wt % tungsten and the balance nickel plus incidental impurities.

RR1000 consists of 14–19 wt % cobalt, 14.35–15.15 wt % chromium, 2.85–3.15 wt % aluminium, 3.45–4.15 wt % titanium, 4.25–5.25 wt % molybdenum, 0.012–0.33 wt % carbon, 0.01–0.025 wt % boron, 0.05–0.07 wt % zirconium, 0–1 wt % hafnium and the balance nickel plus incidental impurities. RR1000 is described more fully in our European patent EP0803585B1.

Alloys 1, 3 and 4 according to the present invention have been processed through a powder metallurgy route and consolidated through extrusion at a temperature below the gamma prime solvus in each case. Each of Alloys 1 to 4 has been evaluated under three heat treatment conditions. Firstly a high temperature solution heat treatment 25° C. below the gamma prime solvus temperature for 4 hours air-cooled, followed by 760° C. for 16 hours stabilisation age. Secondly a high temperature solution heat treatment 50° C. below the gamma prime solvus temperature for 4 hours air-cooled followed by 760° C. for 16 hours stabilisation age. Thirdly a high temperature solution heat treatment 25° C. above the gamma prime solvus temperature for 4 hours air-cooled followed by 760° C. for 16 hours stabilisation age.

Following the heat treatment each of alloys 1 to 4 have been evaluated in terms of tensile strength, creep strength and fatigue strength and in terms of microstructural stability following high temperature exposure.

Alloy 1 is designed to maintain the tensile properties of RR1000 and also improved damage tolerance, creep strength, fatigue strength and high temperature stability. Alloy 1 therefore, is able to operate at higher temperatures compared to RR1000 and is suitable for use at temperatures up to 750° C. Alloy 1 is suitable for use in aero gas turbine engine turbine rotor discs and high pressure compressor rotor discs where the application requires an increase in temperature capability.

TABLE 1

| | Typical Ultimate Tensile Strength MPa | | |
|---|---|---|---|
| Alloy | Sub Gamma' Heat Treatment | Near Gamma' Heat Treatment | Above Gamma' Heat Treatment |
| 1 | >1500 | >1450 | >1450 |
| 2 | >1450 | >1450 | >1450 |
| 3 | >1500 | >1450 | >1450 |
| 4 | >1600 | >1550 | |

TABLE 2

| Alloy | Typical Ultimate Tensile Strength MPa Standard Commercial Heat Treatment |
|---|---|
| RR1000 | >1500 |
| Udimet 720Li | >1450 |
| Waspaloy | >1100 |

Tables 1 and 2 compare the experimental ultimate tensile strength of Alloy 1 with the prior art alloys. The typical ultimate strengths of Alloy 1 are in reasonable agreement with RR1000 and Udimet 720Li and are better than Waspaloy.

Figure 2:
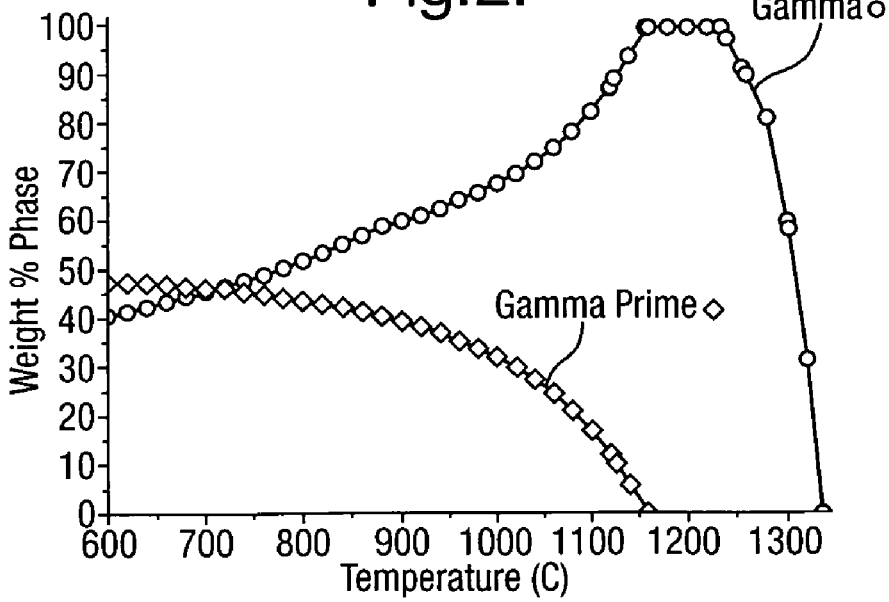
FIG. 2 is a graph showing the change in equilibrium fraction of the gamma phase and gamma prime phase of a prior art alloy.

FIG. 1 shows the change in equilibrium fraction of gamma and gamma prime phases in Alloy 1. FIG. 2 shows the change in equilibrium fraction of gamma and gamma prime phases in RR1000. Alloy 1 comprises approximately 44% of a gamma prime phase strengthener in a gamma phase matrix whereas RR1000 comprises approximately 48% gamma prime phase in the gamma phase matrix. It is to be noted that the gamma prime phase is the main strengthening phase in nickel base superalloys. Additionally Alloy 1 has less molybdenum than RR1000. Molybdenum is also a solid solution strengthening agent. Alloy 1 and RR1000 are compared following identical processing routes and heat treatments, both alloys contain a fine dispersion of intragranular secondary gamma prime between 200 and 250 nm in size. Therefore, despite Alloy 1 having less gamma prime phase than RR1000, Alloy 1 is able to maintain similar strength to RR1000. Therefore, per unit volume, the gamma prime phase in Alloy 1 contributes more to the strength of the alloy than the gamma prime phase in RR1000.

Figure 3:
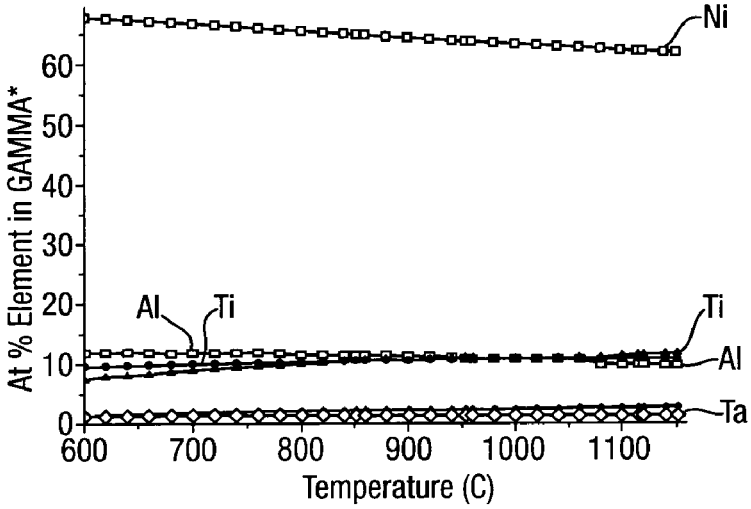
FIG. 3 is a graph showing the change in at % of gamma prime phase gene elements in Alloy 1 of the present invention with temperature.

FIG. 3 shows the equilibrium atomic fraction of the gamma prime gene elements within the gamma prime phase of Alloy 1. The ratio of Al to (Ti and Ta) in Alloy 1 is at an optimum for extracting the maximum strength per unit volume fraction of the gamma prime phase. The ratio of Al to (Ti and Ta) in Alloy 1 is between 0.6 to 0.75 in at %. If additional fractions of the gamma prime gene elements Ti or Ta are added to Alloy 1 such that the Al to (Ti and Ta) ratio falls below 0.6 then this leads to the formation of the detrimental topological close packed eta phase. It is well known that Ti and Ta partition to the gamma prime phase and contribute to the alloy strength through modification of the gamma prime phase lattice parameter. This results in a change in the magnitude of the gamma-gamma prime coherency strains. Furthermore the partitioning of the Ti and Ta to the gamma prime phase increases the anti phase boundary energy for the phase.

TABLE 3

| | Creep Rupture Life 750° C. and 460 MPa | | |
|---|---|---|---|
| Alloy | Sub Gamma' Heat Treatment | Near Gamma' Heat Treatment | Above Gamma' Heat Treatment |
| 1 | >300 | >500 | >700 |
| 2 | >200 | >400 | >600 |
| 3 | >300 | >500 | >700 |
| 4 | >300 | >500 | >700 |

TABLE 4

| Alloy | Creep Rupture Life 750° C. and 460 MPa (Commercial Heat Treatment) |
|---|---|
| RR1000 | >200 |
| Udimet 720Li | >50 |
| Waspaloy | >50 |

Tables 3 and 4 compare the creep rupture life of Alloy 1 with the prior art alloys at 750° C. 460 MPa. Regardless of the heat treatment condition Alloy 1 has a greater creep life than RR1000, Udimet 720Li and Waspaloy. The increasing creep life of Alloy 1 with solution heat treatment temperature is due to the well-known effects of grain size on creep rupture life. In almost all nickel base superalloys tertiary creep is concentrated on the grain boundaries and involves grain boundary sliding and cavitation. The nominal grain size of Alloy 1 after the sub gamma prime, near gamma prime and above gamma prime solvus heat treatment is 12, 18 and 24 μm respectively. An increase in grain size leads to a reduction in grain boundary area and as a result an increase in creep life.

It is to be noted that the creep strength of Alloy 1 after the sub gamma prime solvus heat treatment is higher than that of RR1000 and Udimet 720 Li. The grain size of Alloy 1 after this heat treatment is similar to that in RR1000 and Udimet 720Li. The increase in creep strength is due to a high density of discrete (Ti, Ta, Hf)C and (Cr, Mo)23C6 carbide phases on the grain boundaries. These carbide phases inhibit grain boundary sliding, delaying the onset of grain boundary cavitation and hence increasing the creep life of Alloy 1.

Alloy 1 comprises approximately 0.5 to 1.5 wt % of (Ti, Ta, Hf)C and (Cr, Mo)23C6 carbide particles precipitated on the grain boundary. These (Ti, Ta, Hf)C and (Cr, Mo)23C6 carbide particles are present as 350 to 550 nm diameter discrete blocky particles and strengthen the grain boundary region such that grain boundary sliding is reduced during creep deformation. It is believed that this delays the onset of tertiary creep. Thus Alloy 1 has higher resistance to creep deformation relative to RR1000, Udimet 720Li and Waspaloy.

Alloy 1 has a fatigue crack propagation growth rate that is 30% lower than RR1000 and Udimet 720Li regardless of the heat treatment of Alloy 1. A 30% decrease in the fatigue crack propagation growth rate exists between the sub and near gamma prime solvus heat treatment. This is due to the well known beneficial effects of grain size on fatigue crack growth rates. The grain size of Alloy 1 after the sub, near and above gamma prime solvus heat treatments is nominally 12, 18 and 24 μm respectively. The fatigue crack propagation growth rate for the above gamma prime solvus heat treatment temperature lies between the fatigue crack growth rates for the sub and near gamma prime solvus heat treatment temperatures. This is believed to be due to the large secondary gamma prime size of Alloy 1 when solution heat treated above the gamma prime solvus. The secondary gamma prime size is nominally 200, 250 and 350 nm for the sub, near and above gamma prime solvus heat treatments respectively. It is known that an increase in the secondary gamma prime size decreases the fatigue crack propagation rate.

The optimum heat treatment is from a near, approximately 5° C. below, gamma prime solvus solution heat treatment air-cooled condition. The resultant grain size of 14–20 μm in combination with a secondary gamma prime size of less than 300 nm results in a nickel base superalloy having a fatigue crack propagation rate significantly less than RR1000 and Udimet 720Li.

Figure 6:
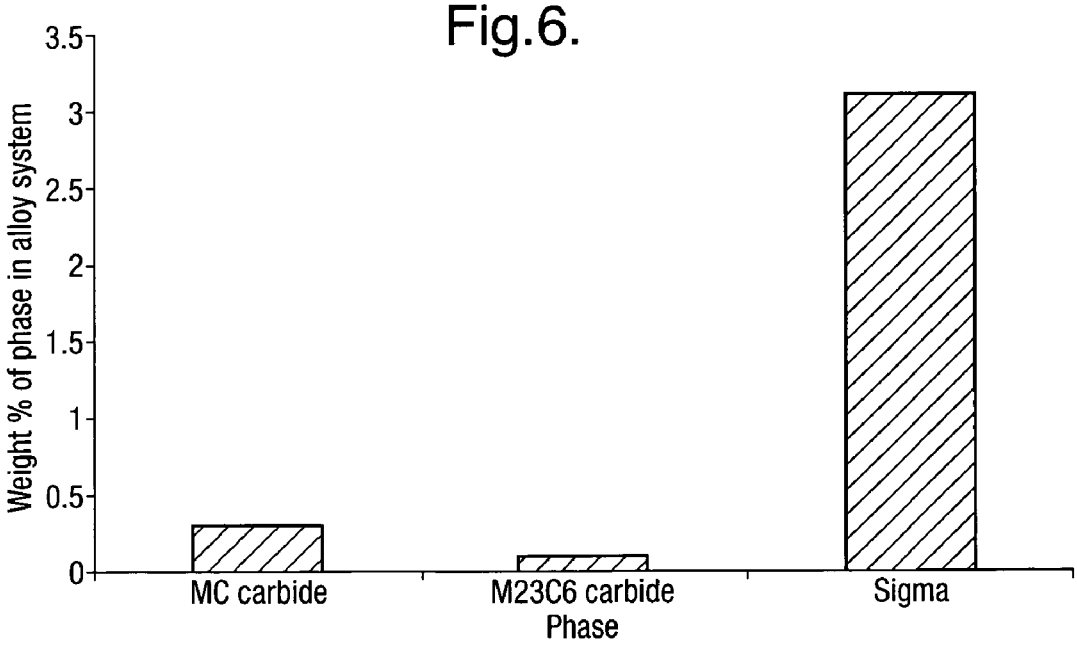
FIG. 6 is a bar chart showing the fraction of grain boundary phase expressed in wt % of prior art alloy following exposure at 800° C. for 2500 hours.
Figure 4A:
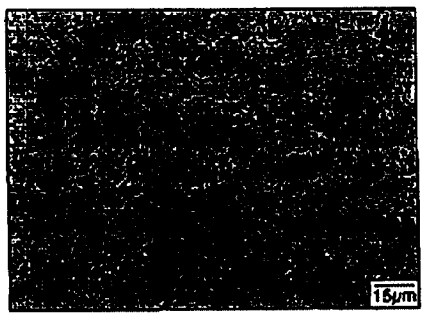
FIGS. 4A and 4B are micrographs of a prior art alloy exposed at 750° C. and 850° C. for 2500 hours.
Figure 4B:
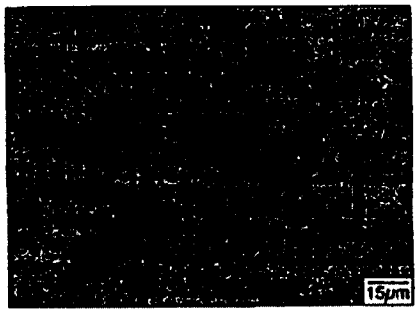
Figure 5A:
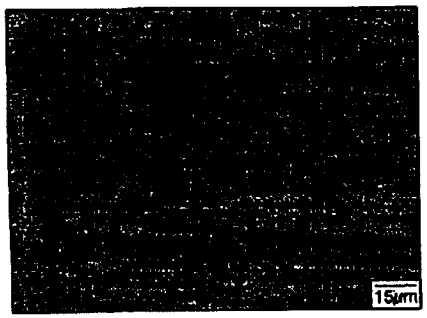
FIGS. 5A and 5B are micrographs of Alloy 1 of the present invention exposed at 750° C. and 850° C. for 2500 hours.
Figure 5B:
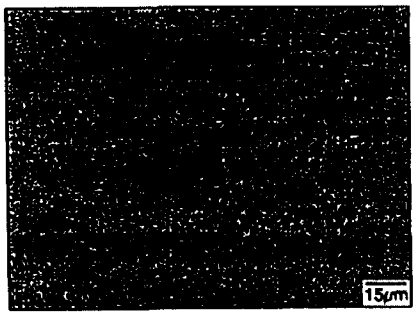
Figure 7:
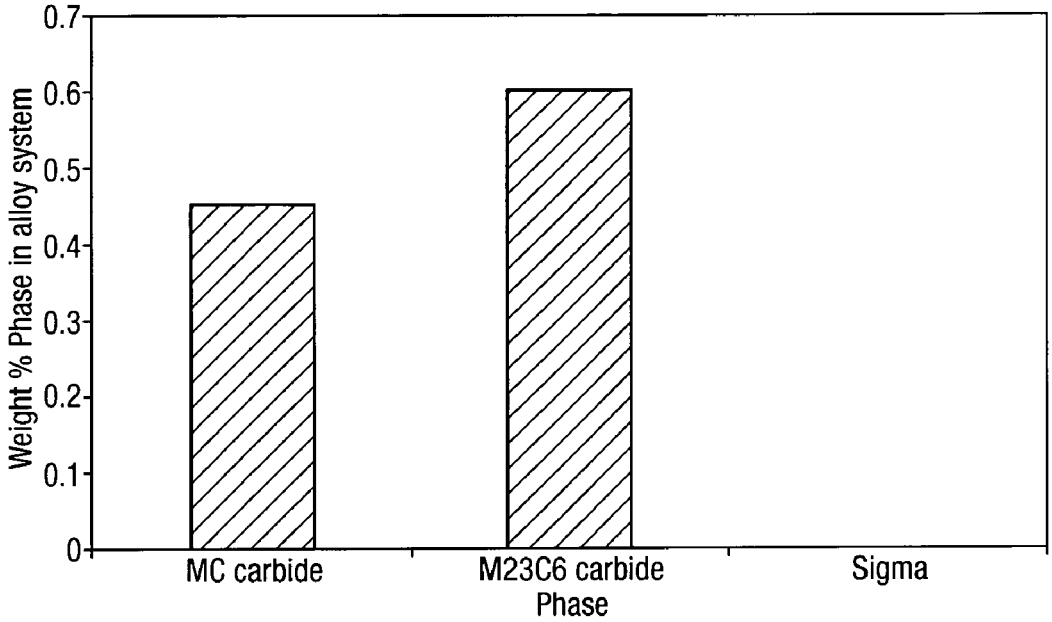
FIG. 7 is a bar chart showing the fraction of grain boundary phase expressed in wt % of Alloy 1 of the present invention following exposure at 800° C. for 2500 hours.
Figure 8:
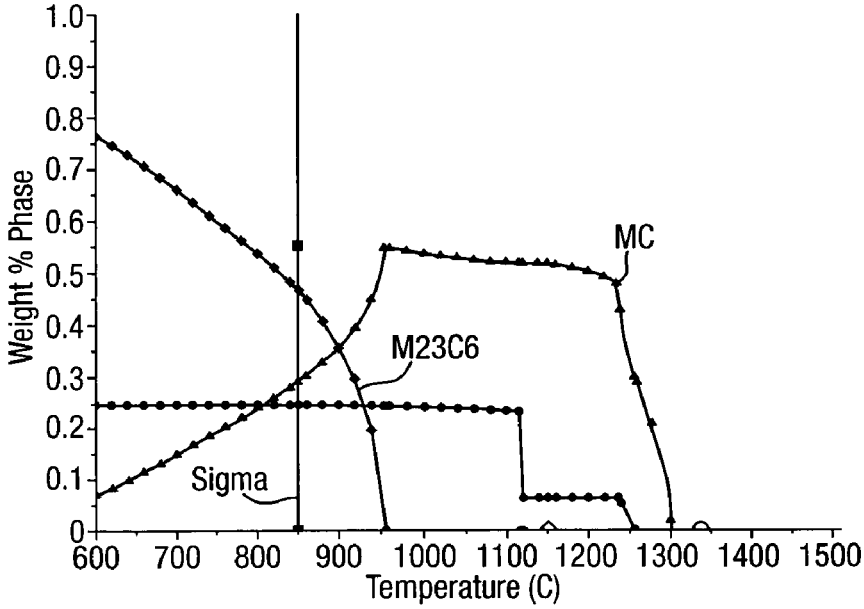
FIG. 8 is graph showing the equilibrium fraction of grain boundary phases in Alloy 1 of the present invention with temperature.

Alloy 1 has been exposed to temperatures up to 800° C. for 2500 hours and up to 750° C. in combination with applied loads of 240 MPa for 2000 hours. Alloy 1 has a combination of (Ti, Ta, Hf)C and (Cr, Mo)C carbides on the grain boundaries in a discrete manner. RR1000 has a high density of semi-continuous sigma phase particles. FIG. 6 shows the weight fraction of grain boundary phases in RR1000 after exposure to 800° C. for 2500 hours and FIG. 7 shows the weight fraction of grain boundary phases in Alloy 1 after exposure to 800° C. for 2500 hours. It is seen that RR1000 has approximately 3 wt % sigma phase precipitated at the grain boundaries, the (Ti, Ta, Hf)C carbide fraction has remained substantially the same and approximately 0.3 wt % (Cr, Mo)23C6 has precipitated relative to unexposed RR1000. Udimet 720Li forms similar amounts of sigma phase on the grain boundaries under similar temperature and time conditions. Alloy 1 has approximately 0.58 wt % (Cr, Mo)23C6 carbide and 0.47 wt % (Ti, Ta, Hf)C carbide and no sigma phase. These measurements are supported by thermodynamic predictions which show approximately 0.35 wt % of (Hf, Ta, Ti)C and 0.55 wt % (Cr, Mo)23C6 carbides. FIG. 8 shows the equilibrium fraction of grain boundary phases in Alloy 1. In the unexposed condition Alloy 1 has approximately 0.7 wt % (Ti, Ta, Hf)C carbide only. Therefore for Alloy 1 exposure to 800° C. for 2500 hours results in the decomposition of the (Ti, Ta, Hf)C carbide and precipitation of the (Cr, Mo)23C6 carbide.

The difference between RR1000 and Alloy 1 is that Alloy 1 forms significantly more carbides than RR1000 at the grain boundaries. The higher level of carbides in Alloy 1 is due to the higher level of carbon and titanium in Alloy 1, sufficient to form between 0.5 and 1.5 wt % (Ti, Ta, Hf)C carbide on the grain boundary. This carbide readily transforms into the chromium and molybdenum rich (Cr, Mo)23C6 carbide. The high levels of hafnium in the (Ti, Ta, Hf)C carbide in addition to the tantalum stabilise the (Ti, Ta, Hf)C in RR1000 and delay the transformation to (Cr, Mo)23C6.

Figure 9:
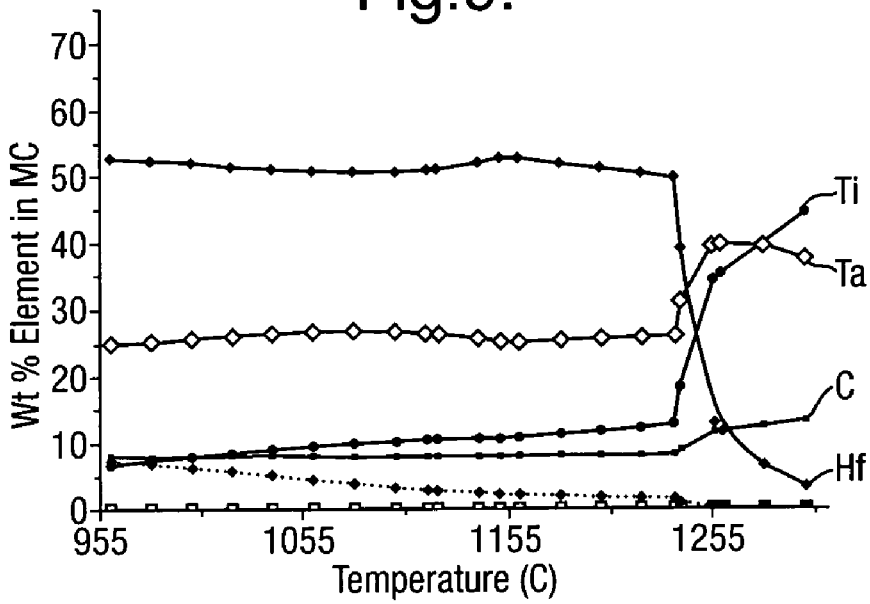
FIG. 9 is a graph showing the change in equilibrium composition of the (Ti, Ta, Hf)C carbide in Alloy 1 of the present invention with temperature.
Figure 10:
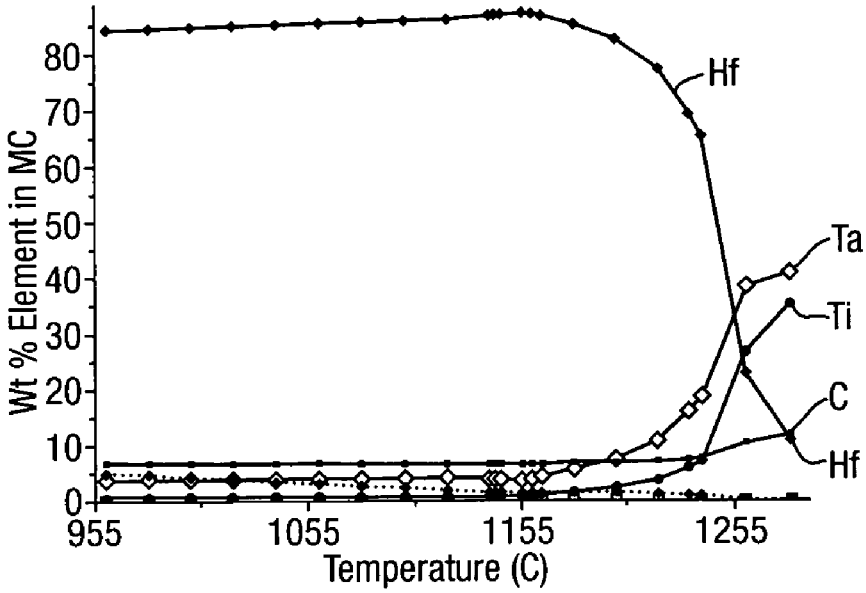
FIG. 10 is a graph showing the change in equilibrium composition of the (Ti, Ta, Hf)C carbide in prior art alloy RR1000 with temperature.

FIG. 9 shows the change in equilibrium composition of the (Ti, Ta, Hf)C carbide with temperature for Alloy 1 and FIG. 10 shows the change in equilibrium composition of the (Ti, Ta, Hf)C carbide with temperature for RR1000. The (Ti, Ta, Hf)C carbide of RR1000 comprises approximately 85 wt % hafnium. Alloy 1 comprises approximately 50 wt % hafnium, 30 wt % tantalum and 15 wt % titanium.

Alloy 1 contains a critical density of (Ti, Ta, Hf)C carbide between 0.5 and 1.5 wt % of a composition comprising not more than 60 wt % hafnium. These carbides form at the grain boundaries with a discrete morphology and are approximately 350 to 550 nm in diameter. The composition of the (Ti, Ta, Hf)C carbide readily transforms to (Cr, Mo)23C6 on exposure to temperature in the range 650° C. to 800° C. This significantly delays the precipitation of chromium and molybdenum rich sigma phase such that substantially no, or very little, sigma phase is formed following exposure to temperature in the range 650° C. to 800° C. for up to 2500 hours.

The introduction of a stress of 240 MPa to Alloy 1 when exposed to a temperature of 750° C. for 2000 hours did not result in any measurable formation of sigma phase.

Alloy 2 is designed to maintain tensile properties, damage tolerance, creep strength and fatigue crack propagation resistance substantially the same as those of RR1000. The mechanical properties of Alloy 2 are achieved by optimising the heat treatment and processing parameters. Alloy 2 is able to provide its mechanical properties without the addition of tantalum and hafnium. The lack of hafnium in Alloy 2 enables Alloy 2 to be manufactured by cast and wrought processing in addition to powder processing. Alloy 2 has a maximum operating temperature of 725° C. Alloy 2 has the advantage of being relatively low cost compared to Alloys 1, 3 and 4 and this makes Alloy 2 suitable for the high pressure compressor rotor discs or turbine rotor discs of industrial gas turbine engines or gas turbine engines operating at intermediate temperatures.

Alloy 2 is post-forged solution heat treated at a temperature 5° C. below the gamma prime solvus. This heat treatment condition produces a uniform microstructure with a nominal grain size of 16 μm. The secondary gamma prime size is in the region of 250 nm +/− 50 nm following air cool. The secondary gamma prime size is in the region of 200 nm +/− 50 nm following oil quenching from the solution heat treatment temperature. Air-cooling is applicable to all processing routes. The oil quench is applicable to Alloy 2 when manufactured using the casting and wrought processing route.

Alloy 2 has an ultimate tensile strength of >1450 MPa at 600° C., see table 1. This is in agreement with the ultimate tensile strength of the prior art alloys in table 2. The fatigue crack propagation resistance of Alloy 2 is comparable to RR1000 and has a 30% better fatigue crack propagation resistance than Udimet 720Li.

The creep rupture life of Alloy 2 with an applied load of 460 MPa at 750° C. for various heat treatment conditions is shown in table 3. The near gamma prime solvus heat treatment gives a typical rupture life greater than 400 hours. This is a significant improvement compared to the prior art alloys in table 4. The increase in creep rupture life is firstly due to the well-known beneficial effect of increasing grain size on creep properties. The prior art alloys RR1000 and Udimet 720Li have a uniform grain size with a nominal grain size of 10 μm, whereas Alloy 2 has uniform grains with a nominal size of 16 μm. Secondly the increase in creep rupture life is due to a high density of discrete TiC and (Cr, Mo)23C6 carbide particles on the grain boundaries. These carbides inhibit boundary sliding delaying the onset of grain boundary cavitation. Alloy 2 comprises approximately 0.5 to 1.5 wt % of TiC and (Cr, Mo)23C6 carbide particles precipitated on the grain boundary. These TiC and (Cr, Mo)23C6 carbide particles are present as 350 to 550 nm diameter discrete blocky particles and strengthen the grain boundary region such that grain boundary sliding is reduced during creep deformation. Thus Alloy 2 has higher resistance to creep deformation relative to RR1000, Udimet 720Li and Waspaloy.

Figure 11:
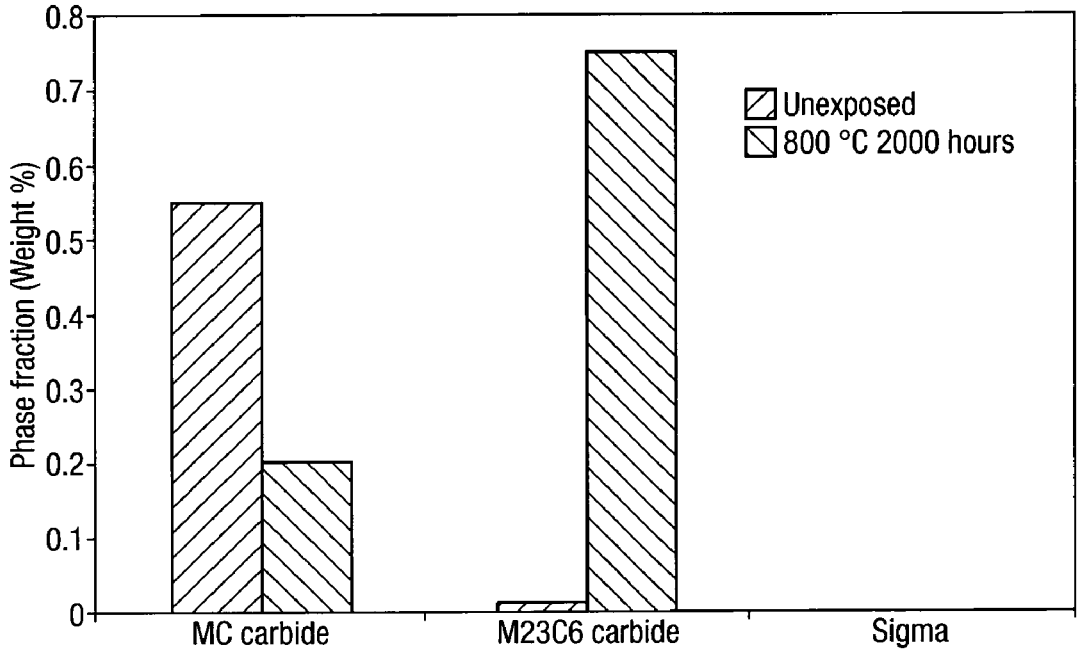
FIG. 11 is a bar chart showing the fraction of grain boundary phase expressed in wt % of Alloy 2 of the present invention following exposure at 800° C. for 2000 hours and in the unexposed condition.

FIG. 11 compares the amount of grain boundary phases in Alloy 2 after exposure to heat treatment of 800° C. for 2000 hours and in the unexposed condition. In the unexposed condition Alloy 2 contains approximately 0.55 wt % TiC. After exposure at 800° C. for 2000 hours the TiC transforms to (Cr, Mo)23C6. Under these conditions there is no evidence of the sigma phase. Alternative combinations of temperature, applied stress and time showed a transition from TiC to (Cr, Mo)23C6 and no evidence of sigma phase.

Alloy 2 contains a critical density of TiC carbide between 0.5 and 1.5 wt % of a composition comprising between 40 wt % and 60 wt % titanium. This carbide forms at the grain boundaries with a discrete morphology and is approximately 350 to 550 nm in diameter. The composition of the TiC carbide readily transforms to (Cr, Mo)23C6 on exposure to temperature in the range 650° C. to 800° C. This significantly delays the precipitation of chromium and molybdenum rich sigma phase such that substantially no, or very little, sigma phase is formed following exposure to temperature in the range 650° C. to 800° C. for up to 2000 hours.

Alloy 3 is designed to maintain the tensile properties of RR1000 in combination with improved damage tolerance in terms of creep strength and fatigue crack propagation resistance and higher temperature stability. The maximum operating temperature of Alloy 3 is 750° C. Alloy 3 has a similar composition to Alloy 1 but differs in that it does not contain any hafnium. The lack of hafnium in Alloy 3 potentially enables Alloy 3 to be manufactured through cast and wrought processing in addition to powder processing. Alloy 3 is suitable for the high pressure compressor rotor discs or turbine rotor discs of aero gas turbine engines or gas turbine engines operating at higher temperatures. The mechanical properties of Alloy 3 are similar to Alloy 1 and are shown in tables 1 and 3.

Alloy 3 comprises approximately 0.6 wt % (Ti, Ta)C carbide. A transition from (Ti, Ta)C to (Cr, Mo)23C6 occurs on exposure under static and stressed conditions without the formation of any measurable sigma phase.

Alloy 3 is capable of operating at temperatures up to 750° C. This alloy maintains its stability with respect to sigma phase formation when exposed to temperatures up to 800° C. for up to at least 2000 hours. Alloy 3 achieves these mechanical properties without the addition of hafnium, which is known to benefit strength, creep and fatigue properties.

Alloy 4 is designed to maintain the damage tolerance, creep strength and fatigue crack propagation resistance and high temperature stability of RR1000 and to have improved tensile strength. The maximum operating temperature of Alloy 4 is 750° C. Alloy 4 is suitable for the high pressure compressor rotor discs or turbine rotor discs of aero gas turbine engines or gas turbine engines operating where the application demands higher temperatures and higher tensile strength.

Figure 12:
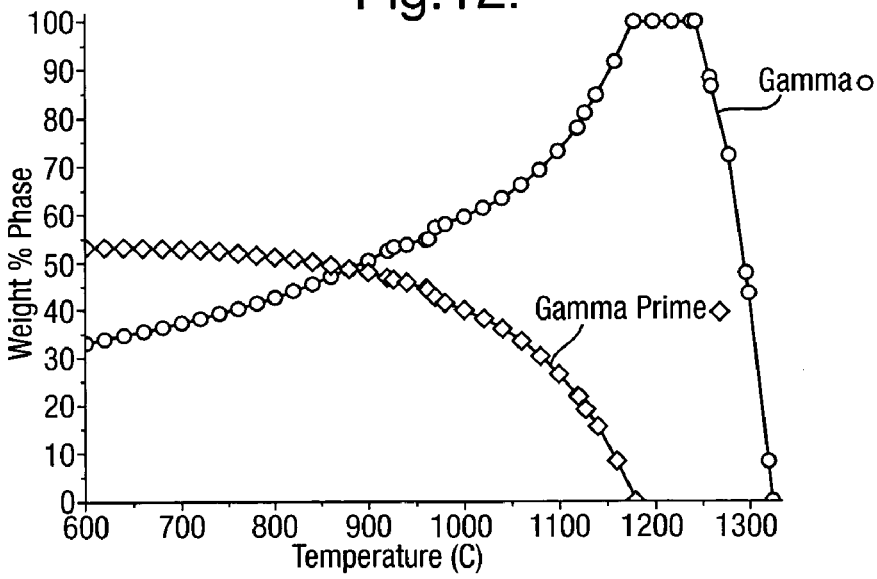
FIG. 12 is a graph showing the equilibrium fraction of gamma and gamma prime phases in Alloy 4 with temperature.

Alloy 4 comprises a greater quantity of the gamma prime gene elements aluminium, titanium and tantalum as indicated above. The total concentration of gamma prime gene elements in Alloy 4 is 10 wt % compared to 8 wt % in Alloy 1. The greater concentration of gamma prime gene elements in Alloy 4 results in a gamma prime volume fraction of approximately 55 wt %. FIG. 12 shows the change in gamma and gamma prime phases with temperature for Alloy 4 and can be compared with FIG. 1 for Alloy 1.

Alloy 1 has a gamma prime volume fraction of 44% and an ultimate tensile strength typically greater than 1450 MPa at 600° C. for a near gamma prime solvus heat treatment. Alloy 4 has a gamma prime volume fraction of 55% and an ultimate tensile strength typically greater than 1550 MPa at 600° C. for a near gamma prime solvus heat treatment. This represents a 100 MPa improvement in ultimate tensile strength relative to Alloy 1 and the prior art alloys RR1000, Waspaloy and Udimet 720Li. The greater volume fraction of gamma prime in Alloy 4 is directly responsible for the greater strength of Alloy 4 relative to Alloy 1 and RR1000, Waspaloy and Udimet 720Li. Alloy 4 maintains the creep rupture strength and fatigue crack propagation resistance similar to Alloy 1 and RR1000. The stability of Alloy 4 with respect to sigma phase is similar to Alloy 1. Exposure of Alloy 4 to temperatures between 650° C. and 800° C. for times up to 2500 hours results in no measurable formation of sigma phase.

Alloy 4 has a (Cr, Mo)23C6 carbide solvus temperature above the chromium rich sigma solvus temperature. The (Ti, Ta)C carbide of Alloy 4 breaks down on heat treatment to form (Cr, Mo)23C6 thereby delaying the formation of the sigma phase.

Additionally a further two alloys according to the present invention have now been produced.

Alloy 5 comprises 17.0 wt % cobalt, 15.0 wt % chromium, 3.1 wt % aluminium, 4.4 wt % titanium, 2.0 wt % tantalum, 4.5 wt % molybdenum, 0.045 wt % carbon, 0.02 wt % boron, 0.06 wt % zirconium, 0.35 wt % hafnium and the balance nickel plus incidental impurities.

Alloy 6 comprises 17.0 wt % cobalt, 15.0 wt % chromium, 3.1 wt % aluminium, 4.4 wt % titanium, 2.5 wt % tantalum, 4.0 wt % molybdenum, 0.045 wt % carbon, 0.035 wt % boron, 0.06 wt % zirconium and the balance of nickel plus incidental impurities.

The nickel base superalloys were developed using an apparatus comprising a computer. The computer comprises a neural network model to predict the ultimate tensile strength and 0.2% proof strength of a given composition at a given temperature and a thermodynamic model to predict the phase fractions and phase compositions for a given nickel base superalloy composition and a given temperature.

Modern nickel base superalloys consist of variable amounts of nine or more elements that result in the formation of multiphase alloys. These alloys gain their strength from solid solution strengthening and precipitation hardening. These strengthening mechanisms are affected by the physical properties such as element concentration, grain size, temperature, particle size and morphology of the phases present. The relative contribution made by each of these variables to the strength of the superalloy and their interaction is complex. Each of these properties is determined by the composition of the superalloy.

The neural network has the ability to recognise and model non linear relationships when presented with complex input data. The neural network can generalise and apply these relationships to previously unseen input data. The neural network was presented with twelve input variables as shown in Table 5.

Thus, known compositions of nickel base superalloy with known ultimate tensile strength, 0.2% proof strength, creep strength and fatigue crack propagation resistance at particular temperatures are input to the neural network. The neural network then determines the ultimate tensile strength and 0.2% proof strength for previously unseen nickel base superalloy compositions and temperatures.

TABLE 5

| Input Variable | Range (wt %) | Output Variable | Range (MPa) |
|---|---|---|---|
| Ni | 38–76 | Yield Strength | 28–1310 |
| Co | 0–20 | UTS | 35–1620 |
| Cr | 12–30 | | |
| Mo | 0–10 | | |
| W | 0–7 | | |
| Al | 0–49 | | |
| Ti | 0–6 | | |
| Ta | 0–2 | | |
| Nb | 0–6 | | |
| C | 0–0.35 | | |
| B | 0–0.016 | | |
| Zr | 0–0.2 | | |
| Temperature | 21–1093° C. | | |

The thermodynamic model calculates the equilibrium fraction of phases and individual element partitioning behaviour as a function of temperature when presented with bulk alloy element concentrations. The thermodynamic model contains mathematical algorithms which are used to determine the alloy phase characteristics. The mathematical algorithms use a database containing thermodynamic data for the alloy system of interest. The database contains essential technical data such as enthalpies of formation, entropy, chemical potentials, interaction coefficients, heat capacity and crystal structures. The thermodynamic calculations are based upon the minimisation of the Gibbs free energy. The assumption is made that the phases predicted within the alloy system of interest are at equilibrium at a predefined temperature. Nickel base superalloys are processed at very high temperatures where physical states close to equilibrium are feasible. The experimental data contained in the present invention validates the thermodynamic calculations. The thermodynamic model was presented with twelve input variables and fourteen possible resultant output phases as shown in Table 6.

TABLE 6

| Input Element | Range (wt % unless Stated otherwise) | Output Phase |
|---|---|---|
| Ni—Al—Ti | 50–100 at % | Liquid |
| Cr | 0–30 | Gamma Matrix |
| Co | 0–25 | Gamma Prime |
| W | 0–15 | MC Carbide |
| Ta | 0–15 | M6C Carbide |
| Mo | 0–10 | M23C6 Carbide |
| Nb | 0–10 | M7C3 Carbide |
| Hf | 0–3 | M3B2 Boride |
| C | 0–0.3 | MB2 Boride |
| B | 0–0.1 | Sigma Phase |
| Zr | 0–0.1 | Mu Phase |
| | | Eta Phase |
| | | Ni3Nb |
| | | Laves Phase |

The neural network model in combination with the thermodynamic model are used to optimise alloy chemistry. The neural network model predicts the strength, the ultimate tensile strength and 0.2% proof strength of the alloy as a function of the chemistry. Alloys exhibiting the greatest strength also contain relatively high fractions of the gamma prime gene elements and solid solution strengthening elements. Typically, the alloys which have the greatest strength are susceptible to the formation of the sigma phase and eta phase. The sigma phase and eta phase are detrimental to the creep and fatigue properties of the alloy. The thermodynamic model identifies the high strength alloys which have a high degree of stability and which do not form detrimental concentrations or the sigma and eta phases.

We claim:

1. A nickel base superalloy consisting of 14.0 to 20.0 wt % cobalt, 13.5 to 17.0 wt % chromium, 2.5 to 4.0 wt % aluminium, 3.4 to 5.0 wt % titanium, 0 to 3.0 wt % tantalum, 3.8 to 5.5 wt % molybdenum, 0.035 to 0.07 wt % carbon, 0.01 to 0.04 wt % boron, 0.055 to 0.075 wt % zirconium, 0 to 0.4 wt % hafnium and the balance nickel plus incidental impurities, and comprising 40 to 60 wt % gamma prime phase.

2. A nickel base superalloy as claimed in claim 1 consisting of 16.0 to 20.0 wt % cobalt, 14.5 to 17.0 wt % chromium, 2.5 to 3.5 wt % aluminium, 3.4 to 5.0 wt % titanium, 0 to 3.0 wt % tantalum, 3.8 to 4.5 wt % molybdenum, 0.035 to 0.07 wt % carbon, 0.01 to 0.04 wt % boron, 0.055 to 0.075 wt % zirconium, 0 to 0.4 wt % hafnium and the balance nickel plus incidental impurities.

3. A nickel base superalloy as claimed in claim 2 consisting of 16.5 to 19.0 wt % cobalt, 15.0 to 16.0 wt % chromium, 2.7 to 3.5 wt % aluminium, 3.75 to 4.75 wt % titanium, 1.0 to 3.0 wt % tantalum, 3.8 to 4.5 wt % molybdenum, 0.035 to 0.07 wt % carbon, 0.01 to 0.04 wt % boron, 0.055 to 0.075 wt % zirconium, 0 to 0.4 wt % hafnium and the balance nickel plus incidental impurities.

4. A nickel base superalloy as claimed in claim 3 consisting of 1.5 to 2.8 wt % tantalum.

5. A nickel base superalloy consisting of 18.0 wt % cobalt, 15.5 wt % chromium, 2.8 wt % aluminium, 3.8 wt % titanium, 1.75 wt % tantalum, 4.25 wt % molybdenum, 0.045 wt % carbon, 0.02 wt % boron, 0.06 wt % zirconium, 0.35 wt % hafnium and the balance nickel plus incidental impurities.

6. A nickel base superalloy as claimed in claim 5 wherein the superalloy comprises gamma prime phase in a gamma phase matrix, the ratio of aluminium to (titanium and tantalum) is at an optimum for providing the maximum strength per unit fraction of gamma prime phase.

7. A nickel base superalloy as claimed in claim 6 wherein the ratio of aluminium to (titanium and tantalum) is 0.6 to 0.75 in at %.

8. A nickel base superalloy as clamed in claim 5 wherein the superalloy comprises (Ti+Ta+Hf)C carbide and M23C6 carbide particles on the grain boundaries, the carbide particles have dimensions of 350 to 550 nm.

9. A nickel base superalloy as claimed in claims 5 wherein the gamma phase matrix has a grain size of 14 to 20 μm and the gamma prime phase has a size of less than 300 nm.

10. A nickel base superalloy as claimed in claim 8 wherein the superalloy comprises 0.5 to 1.5 wt % (Ti+Ta+Hf)C carbide, the (Ti+Ta+Hf)C carbide comprising up to 60 wt % Hf.

11. A nickel base superalloy consisting of 18.0 wt % cobalt, 15.5 wt % chromium, 2.8 wt % aluminium, 3.8 wt % titanium, 4.25 wt % molybdenum, 0.045 wt % carbon, 0.02 wt % boron, 0.06 wt % zirconium and the balance nickel plus incidental impurities.

12. A nickel base superalloy as claimed in claim 11 wherein the superalloy comprises TiC carbide and M23C6 carbide particles on the grain boundaries, the carbide particles have dimensions of 350 to 550 nm.

13. A nickel base superalloy as claimed in claim 12 wherein the superalloy comprises 0.5 to 1.5 wt % TiC carbide, the TiC carbide comprising 40 to 60 wt % Ti.

14. A nickel base superalloy consisting of 18.0 wt % cobalt, 15.5 wt % chromium, 2.8 wt % aluminium, 4.4 wt % titanium, 1.75 wt % tantalum, 4.5 wt % molybdenum, 0.045 wt % carbon, 0.02 wt % boron, 0.06 wt % zirconium and the balance nickel plus incidental impurities.

15. A nickel base superalloy as claimed in claim 4 consisting of 17.0 wt % cobalt, 15.0 wt % chromium, 3.1 wt % aluminium, 4.4 wt % titanium, 2.5 wt % tantalum, 4.0 wt % molybdenum, 0.045 wt % carbon, 0.02 wt % boron, 0.06 wt % zirconium and the balance nickel plus incidental impurities.

16. A nickel base superalloy as claimed in claim 1 consisting of 17.0 wt % cobalt, 15.0 wt % chromium, 3.1 wt % aluminium, 4.4 wt % titanium, 2.5 wt % tantalum, 4.0 wt % molybdenum, 0.045 wt % carbon, 0.035 wt % boron, 0.06 wt % zirconium, and the balance nickel plus incidental impurities.

17. A nickel base superalloy as claimed in claim 1 consisting of 17.0 wt % cobalt, 15.0 wt % chromium, 3.1 wt % aluminium, 4.4 wt % titanium, 2.0 wt % tantalum, 4.5 wt % molybdenum, 0.045 wt % carbon, 0.02 wt % boron, 0.06 wt % zirconium, 0.35 wt % hafnium and the balance nickel plus incidental impurities.

18. A nickel base superalloy as claimed in claim 1 comprising 44 wt % gamma prime phase.

19. A nickel base superalloy as claimed in claims 11 comprising 44 wt % gamma prime phase.

20. A nickel base superalloy as claimed in claim 14 comprising 44 wt % gamma prime phase.

21. A nickel base superalloy consisting of 17.0 wt % cobalt, 15.0 wt % chromium, 3.1 wt % aluminium, 4.4 wt % titanium, 2.5 wt % tantalum, 4.0 wt % molybdenum, 0.045 wt % carbon, 0.02 wt % boron, 0.06 wt % zirconium and the balance nickel plus incidental impurities, and comprising 55 wt % gamma prime phase.

22. A nickel base superalloy as claimed in claim 1 consisting of 15.0 to 19.0 wt % cobalt, 14.5 to 16.0 wt % chromium, 2.7 to 3.5 wt % aluminium, 3.6 to 4.7 wt % titanium, 0 to 2.8 wt % tantalum, 4.0 to 5.0 wt % molybdenum, 0.035 to 0.07 wt % carbon, 0.01 to 0.04 wt % boron, 0.055 to 0.075 wt % zirconium, 0 to 0.4 wt % hafnium and the balance nickel plus incidental impurities.

23. A gas turbine engine rotor disc comprising a nickel base superalloy as claimed in claim 1.

24. A gas turbine engine rotor disc as claimed in claim 23 wherein the rotor disc is a turbine rotor disc or a high pressure compressor rotor disc.

25. A nickel base superalloy according to claim 1 consisting of 14.0 to 20.0 wt % cobalt, 13.5 to 17.0 wt % chromium, 2.5 to 4.0 wt % aluminium, 3.4 to 5.0 wt % titanium, 1.5 to 2.8 wt % tantalum, 3.8 to 5.5 wt % molybdenum, 0.035 to 0.07 wt % carbon, 0.01 to 0.04 wt % boron, 0.055 to 0.075 wt % zirconium, 0 to 0.4 wt % hafnium and the balance nickel plus incidental impurities.

26. A nickel base superalloy as claimed in claim 14, wherein the superalloy comprises (Ti+Ta) C carbide and M23C6 carbide particles.

27. A nickel base superalloy as claimed in claim 26, wherein the superalloy comprises wt. % (Ti+Ta)C carbide.

28. A nickel base superalloy according to claim 1 consisting of 17.0 wt % cobalt, 15.0 wt % chromium, 3.1 wt % aluminium, 4.4 wt % titanium, 2.5 wt % tantalum, 4.0 wt % molybdenum, 0.045 wt % carbon, 0.02 wt % boron, 0.06 wt % zirconium and the balance nickel plus incidental impurities, wherein the superalloy comprises (Ti+Ta) C carbide and M23C6 carbide particles.

29. A nickel base superalloy consisting of 17.0 wt % cobalt, 15.0 wt % chromium, 3.1 wt % aluminium, 4.4 wt % titanium, 2.0 wt % tantalum, 4.5 wt % molybdenum, 0.045 wt % carbon, 0.02 wt % boron, 0.06 wt % zirconium, 0.35 wt % hafnium and the balance nickel plus incidental impurities, wherein the superalloy comprises (Ti+Ta+Hf)C carbide and M23C6 carbide particles on the grain boundaries, the carbide particles have dimensions of 350 to 550 nm.

30. A nickel base superalloy consisting of 14.0 to 20.0 wt % cobalt, 13.5 to 17.0 wt % chromium, 2.5 to 4.0 wt % aluminium, 3.4 to 5.0 wt % titanium, 0 to 3.0 wt % tantalum, 3.8 to 5.5 wt % molybdenum, 0.035 to 0.07 wt % carbon, 0.01 to 0.04 wt % boron, 0.055 to 0.075 wt % zirconium, 0 to 0.4 wt % hafnium and the balance nickel plus incidental impurities, wherein the amount of Al is from 2.5 to 3.1 wt. %.

31. A nickel base superalloy as claimed in claim 1–18 consisting of 17.0 wt % cobalt, 15.0 wt % chromium, 3.1 wt % aluminium, 4.4 wt % titanium, 2.5 wt % tantalum, 4.0 wt % molybdenum, 0.045 wt % carbon, 0.035 wt % boron, 0.06 wt % zirconium, and the balance nickel plus incidental impurities.

* * * * *